US005476366A

United States Patent [19]

Weihsmann

[11] Patent Number: 5,476,366

[45] Date of Patent: Dec. 19, 1995

[54] FAN CONSTRUCTION AND METHOD OF ASSEMBLY

[75] Inventor: Peter R. Weihsmann, Fort Smith, Ark.

[73] Assignee: Baldor Electric Co., Fort Smith, Ark.

[21] Appl. No.: 309,397

[22] Filed: Sep. 20, 1994

[51] Int. Cl.[6] ..... F01D 5/32

[52] U.S. Cl. ..... 416/220 A; 416/219 A; 416/218

[58] Field of Search ..... 416/220 A, 219 A, 416/218, 193 A

[56] References Cited

U.S. PATENT DOCUMENTS

| | | | |
|---|---|---|---|
| 612,598 | 10/1898 | Wanless | 416/220 A |
| 2,660,400 | 11/1953 | Griffith | 416/193 A |
| 3,073,395 | 1/1963 | Duncan | 416/220 A |
| 4,389,161 | 6/1983 | Brumen | 416/218 |
| 4,669,164 | 6/1987 | Phelps | 416/219 A |
| 4,930,987 | 6/1990 | Stahl | 416/219 A |
| 5,354,177 | 11/1994 | Chang | 416/219 A |

FOREIGN PATENT DOCUMENTS

| | | | |
|---|---|---|---|
| 0210940 | 2/1987 | European Pat. Off. | 416/193 A |
| 0740757 | 11/1955 | United Kingdom | 416/193 A |
| 2006884 | 5/1979 | United Kingdom | 416/218 |

*Primary Examiner*—Edward K. Look
*Assistant Examiner*—Mark Sgantzos
*Attorney, Agent, or Firm*—Marshall, O'Toole, Gerstein, Murray & Borun

[57] ABSTRACT

This disclosure relates to a fan for an electric machine, the fan comprising a hub having a centrally located bore sized to receive the shaft of the machine, the bore having an axis which coincides with the shaft axis. The fan further comprises a plurality of angularly spaced fan blades which extend radially outwardly from the hub. The blades are formed separately from the hub and are secured to the hub by an improved interlocking joint arrangement. A series of hubs which are substantially identical except for the shaft bore diameter are provided, and a series of blades which are substantially identical except for the radial length are provided. Thus, a hub matching a specified shaft diameter, and a blade length matching a specified housing size, may be selected and assembled to match a machine.

11 Claims, 5 Drawing Sheets

FAN CONSTRUCTION AND METHOD OF ASSEMBLY

FIELD AND BACKGROUND OF THE INVENTION

This invention relates to a fan, and more specifically, to the structure of a fan particularly suited for use with electro-machinery.

Electro-machinery such as an electric motor generates a sizeable amount of internal heat during operation, and it is common practice to provide the motor with a cooling fan. A fan is mounted on the motor drive shaft, and the fan turns with the shaft during operation and produces cooling air flow around the motor. One particular type of motor is referred to in the trade as a Totally Enclosed Fan Cooled (TEFC) motor, and it includes a fan mounted on the rotor shaft outside the motor housing or shell. The fan causes cooling air to flow around external cooling fins formed on the motor housing. The fan is typically made of a high strength plastic, and is produced by an injection molding process.

A problem encountered in the manufacture of an injection molded fan is that the molds are quite expensive for the fan of a large size motor. Such a fan may have an outer diameter between one-two feet, for example. Since the cost of a mold increases approximately with the cube of its size, it will be apparent that the cost of a mold for a large one-piece fan may be quite high. This problem of relatively high cost of molding large parts is often exacerbated by the relatively low volume of large parts. If the volume is at least, for example, 10,000 to 15,000 parts per year, injection molding is economically feasible, but a low volume, large size part may be excessively expensive to produce when molding prior art designs for large motors.

It is a general object of the present invention to provide an improved fan design which may be economically manufactured by injection molding, in a variety of sizes.

SUMMARY OF THE INVENTION

A fan constructed in accordance with this invention comprises a hub having a centrally located bore sized to receive the shaft of an electro-mechanical machine, the bore having an axis which coincides with the shaft axis. A plurality of angularly spaced fan blades extend radially outwardly from the hub. The blades are formed separately from the hub and are secured to the hub by an improved interlocking arrangement. A series of hubs which are substantially identical except for the shaft bore diameter are provided, and a series of blades which are substantially identical except for the radial length and the width are provided. Thus, a hub matching a specified shaft diameter, and a blade length matching a specified housing size, may be selected and assembled to match a machine.

DESCRIPTION OF THE DRAWINGS

The invention may be better understood from the following detailed description taken in conjunction with the accompanying figures of the drawings wherein.

DETAILED DESCRIPTION OF THE INVENTION

Figure 1:
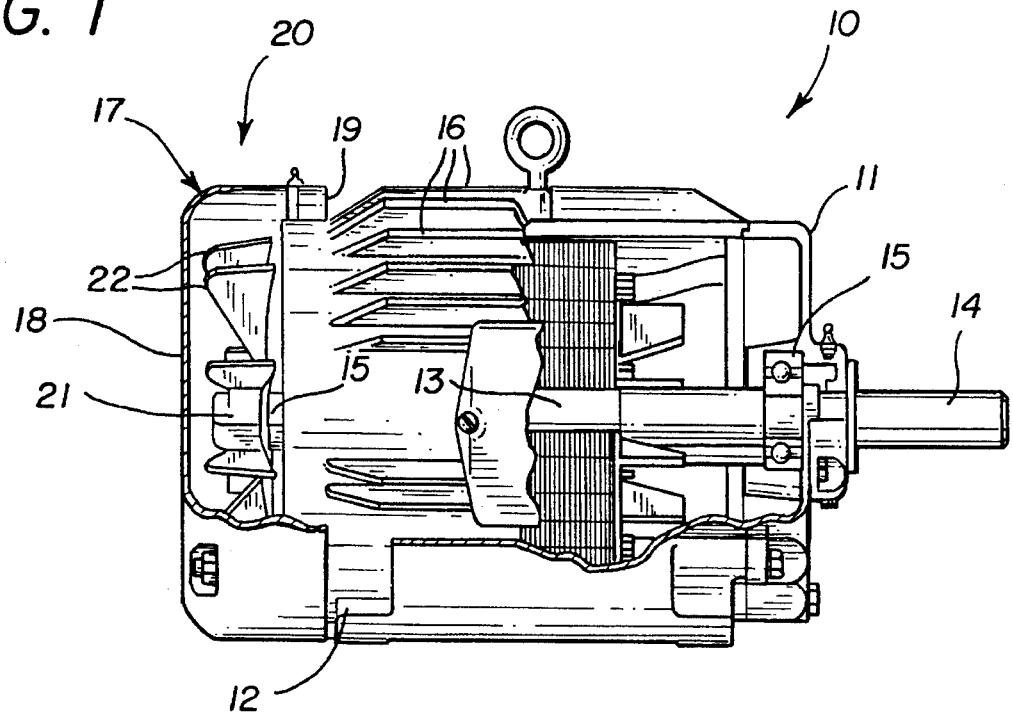
FIG. 1 is a diagrammatic view of a machine including a fan constructed in accordance with the invention.

While the following description makes reference to an electric motor, and while FIG. 1 shows one type of motor, it will be apparent that the invention is also applicable to other types of machinery. Further, while the following description relates to a radial flow fan, the invention is also applicable to other types of fans.

With reference first to FIG. 1, a motor 10 includes a housing or shell 11 supported on a base 12. A rotor shaft 13 is rotatably mounted in the housing by suitable bearings 15, and at least one end 14 of the shaft extends out of the rearward end of the housing for coupling to a device to be driven. The housing 11 totally encloses the stator and the rotor of the motor (except for the ends of the shaft 13). In the example illustrated in FIG. 1, angularly spaced cooling fins 16 are formed on the outer periphery of the housing 11, but the motor may instead include a finless metal housing.

Figure 2:
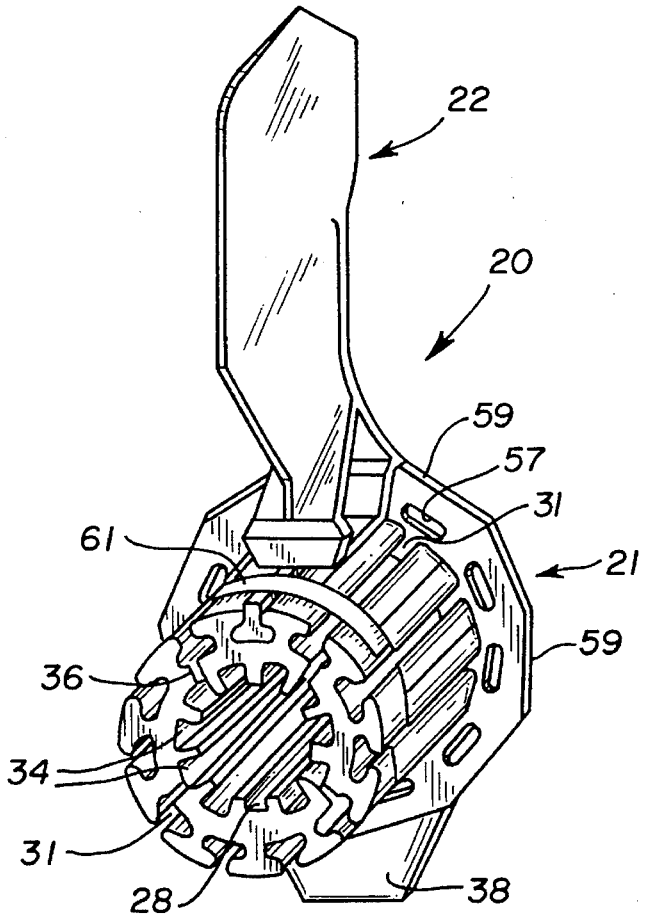
FIG. 2 is an enlarged perspective view of a portion of a fan mounted on the shaft.

Mounted on the other end 15 of the shaft 13 and rotatable with the shaft 15 is a radial flow fan 20 which produces a circulation of the air around the fins 16, for cooling purposes. As best shown in FIG. 2, the fan 20 is formed by a cylindrical hub 21 which is secured to the shaft 13, and by a plurality (only one illustrated in FIG. 2) of angularly spaced identical fan blades 22 which are attached to and extend radially outwardly from the hub 21. The fan 20 is enclosed within a fan shroud 17 which is attached to the motor housing 11. The shroud 17 includes air intake vents formed in the center area 18, and an air outlet passage 19 is formed between the shroud 17 and housing 11. Rotation of the fan blades 22 causes air to be drawn into the center of the fan through the intake vents, and to be expelled through the outlet passage 19 to the cooling fins 16. The hub and the blades are preferably made by an injection molding process utilizing a conventional thermo-plastic material of a type in common use in the industry. An example of a suitable material is polypropylene, and if static electricity is a problem, an electrically conductive polypropylene may be used. Of course, other suitable materials may be used.

It is an important feature that the hub 21 is formed separately from the blades 22 and the blades are formed separately from each other, and that a strong coupling is formed between the hub and the blades. It is another important feature that the radial dimension of the blades may be selected to match the shroud size, and that the hub has a bore size that may be selected to match the shaft diameter of different motor sizes.

Figure 3:
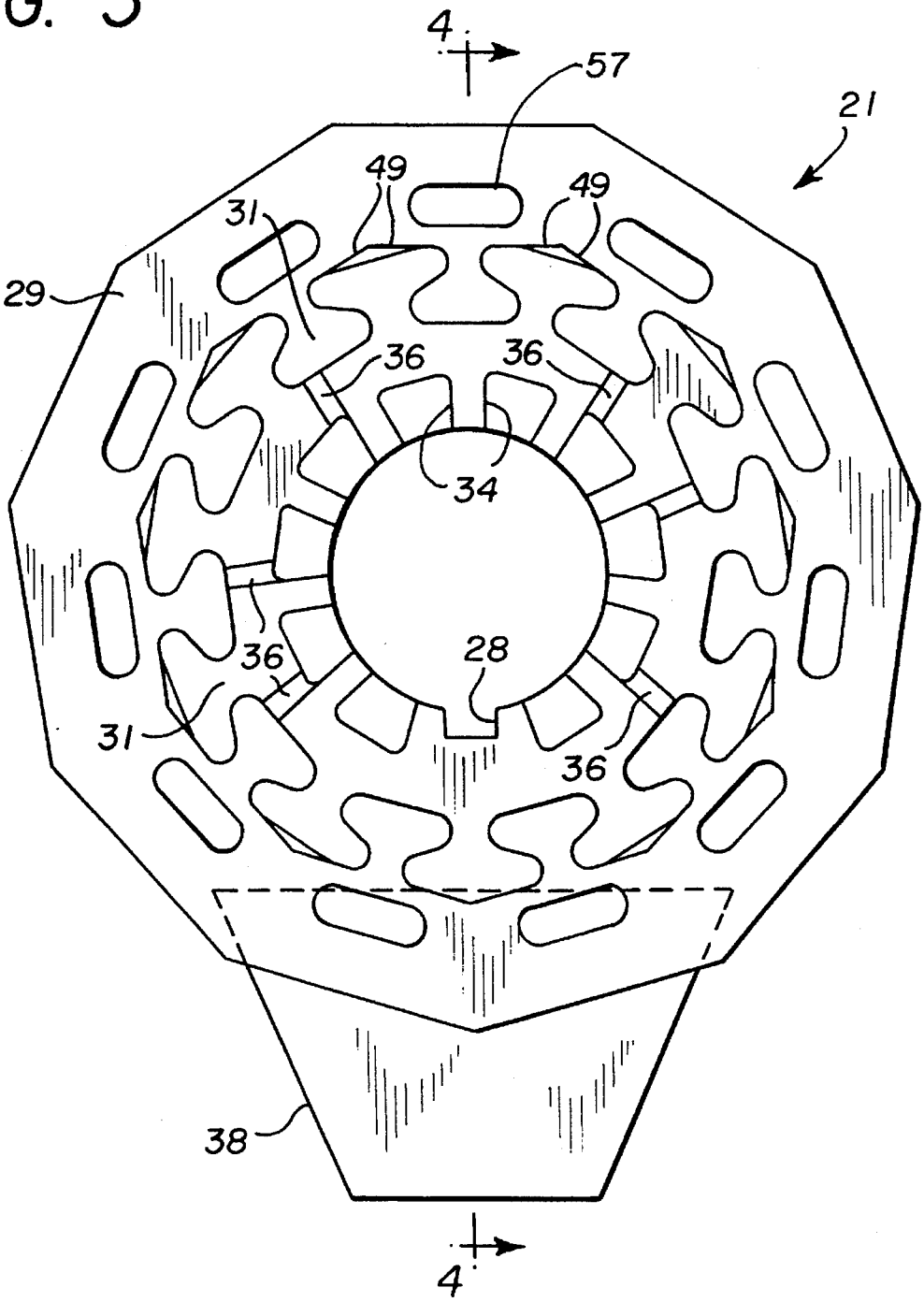
FIG. 3 is a view of a hub of the fan.
Figure 4:
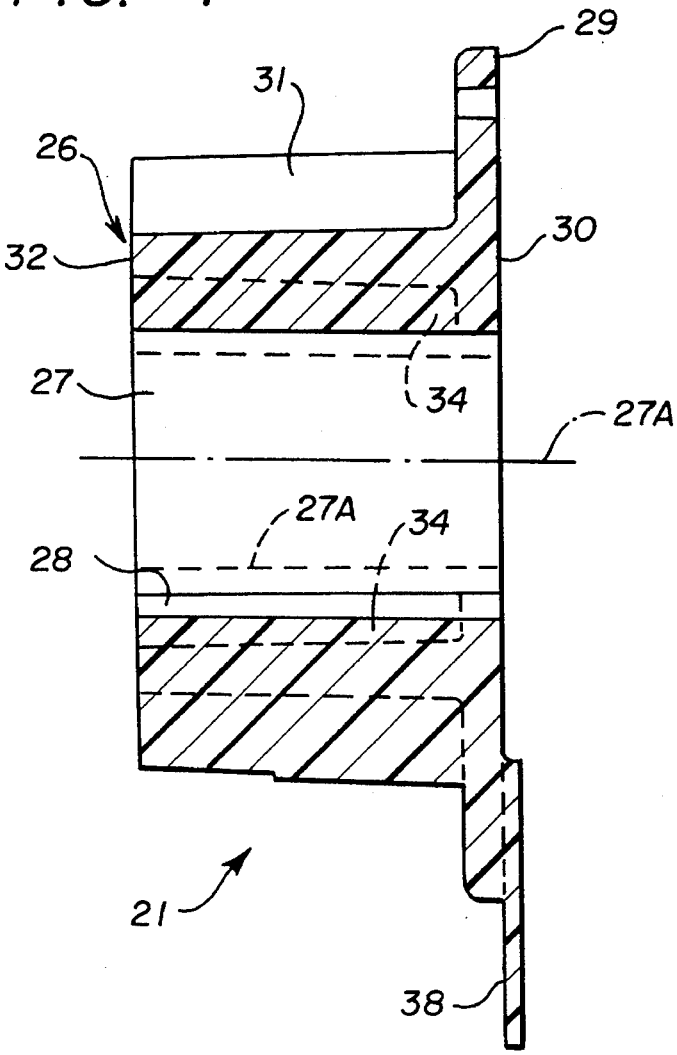
FIG. 4 is a sectional view taken on the line 4—4 of FIG. 3.

With specific reference to FIGS. 3 and 4, the hub 21 includes a generally cylindrical body part 26 having a central bore 27 formed through it. The bore 27 is sized to receive the cylindrical motor shaft 13 (both rotate on the bore axis 27A), and a key way 28 is formed in the bore to provide for a key connection with the shaft 13. At the rearward (the right-hand as seen in FIG. 4) end 30 of the hub is formed a radial flange 29 which is integral with the body part 26. At angularly spaced locations around the outer periphery of the body 26 are a plurality of mounting grooves or slots 31, there being one slot 31 for each of the blades 22. The slots 31 extend from the forward face 32 (at the left end as seen in FIG. 4) up to the flange 29, and the bottoms of the grooves are circumferentially widened. The grooves may have a dovetail, T-tail, onion shape, etc., and in the present instance, they have a dovetail shape in cross section as shown in FIG. 3.

In the surface of the bore 27 are formed a plurality of axially extending internal grooves 34, the grooves 34 extending from the forward face 32 up to the flange 29. As shown in FIG. 3, the grooves 34 are formed around the inner periphery of the hub 21 and are provided to minimize molding time (solidification time) by giving the hub parts a substantially equal thickness. Radially outwardly of the grooves 34 are a plurality of slots 36 which extend radially through the hub. In the present illustration, the slots 36 extend from the bottoms of some of the dovetail slots 31 to the outer ends of selected internal grooves 34. The slots 36 extend from the forward face 32 up to about midway in the length of the body part 26. Thus, in the areas of the slots 36, radial through openings are formed from the interior to the exterior of the body part 26. The through openings allow for contraction of the body part on the shaft 13, as will be described.

As illustrated in FIG. 3, the wall portions forming the body part 26 and the flange 29 have a substantially constant or equal thicknesses, which is highly advantageous when forming molded parts.

Extending radially outwardly from one side of the flange 29 is a balance plate 38 which is formed integrally with the flange. As will be described, the plate 38 corrects for any imbalance due to eccentricity of the hub and for a clamp to be described hereinafter.

Figure 6:
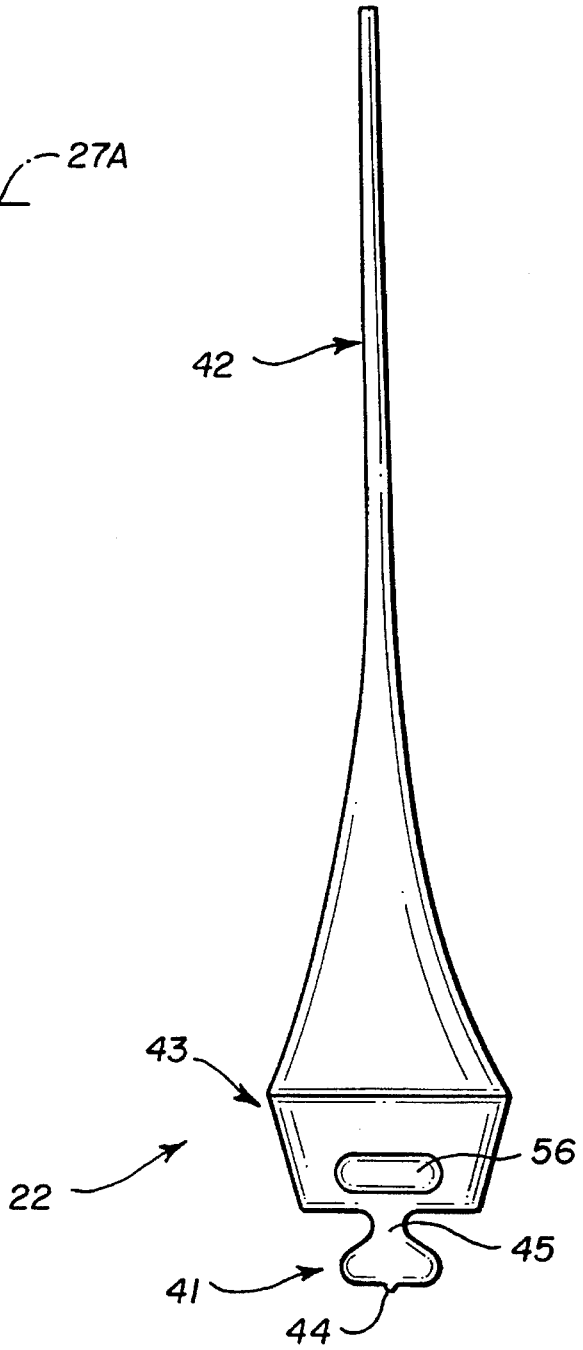
FIG. 6 is a view taken on the line 6—6 of FIG. 5.
Figure 5:
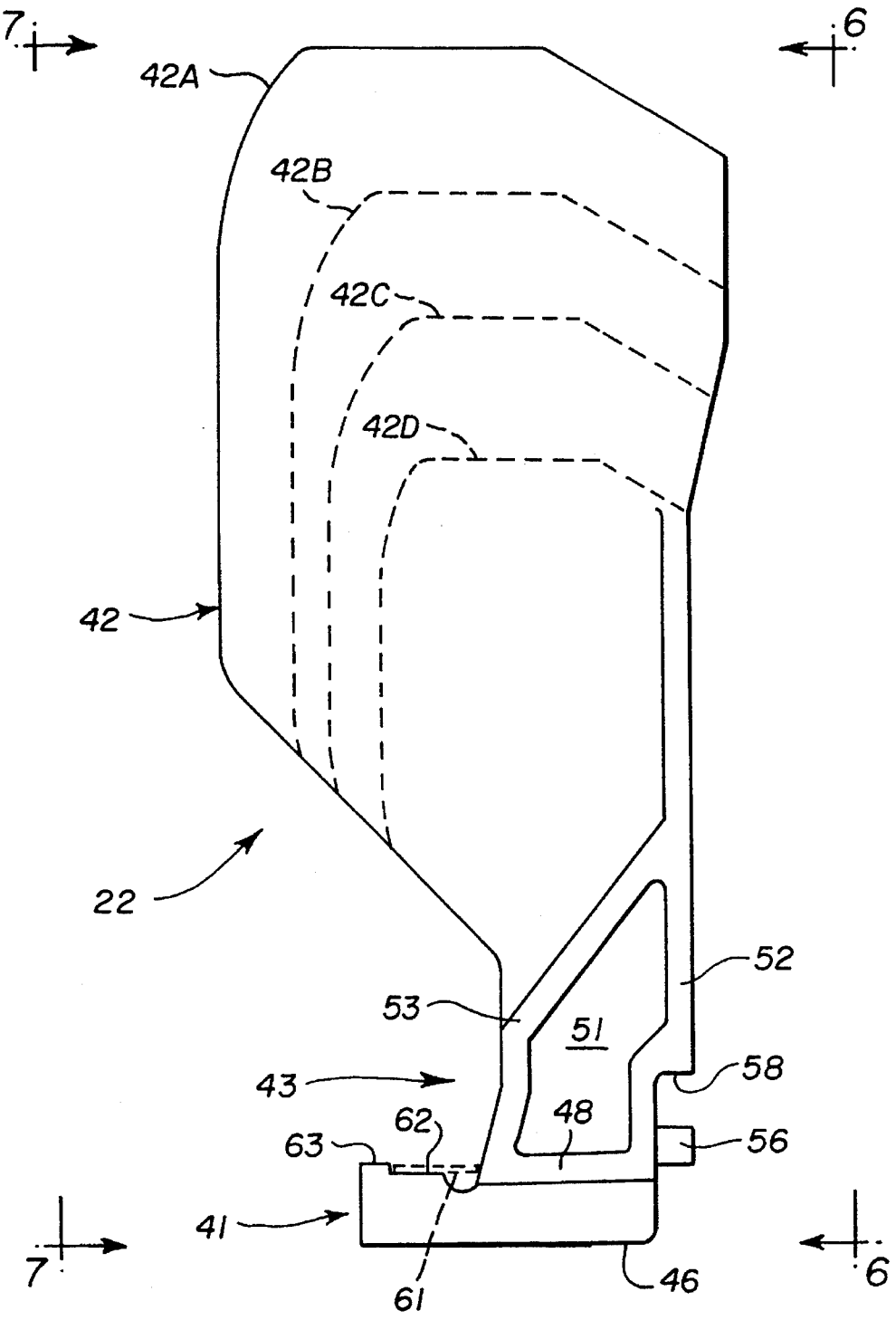
FIG. 5 is a side view of a blade of the fan.
Figure 7:
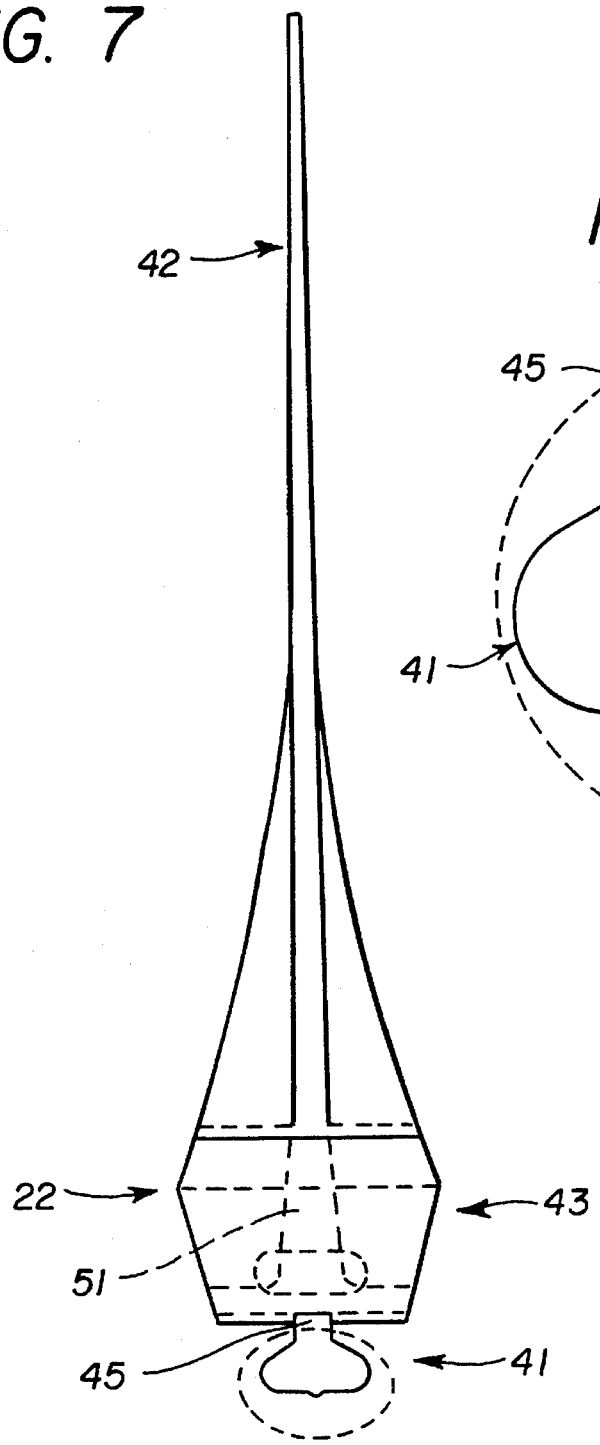
FIG. 7 is a view taken on the line 7—7 of FIG. 5.

Turning now to the blades 22, all of the blades of a set selected for a given motor size are identical. With reference to FIGS. 5 to 7, each blade comprises a circumferentially widened part 41 (a dovetail part), a blade part 42 and a blade support part 43 connecting the parts 41 and 42.

Figure 8:
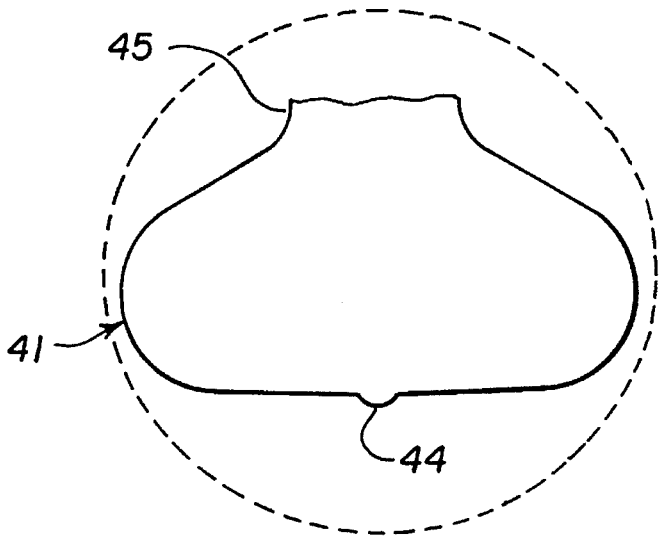
FIG. 8 is an enlarged view of the portion in dashed lines in FIG. 7.

The dovetail part 41 is sized and shaped to mate with and fit snugly into one of the grooves 31, and the axial length of the part 41 is substantially that of the groove 31. The dovetail includes a widened bottom part and an upwardly extending neck 45 which extends out of the groove 31. On the bottom side of the dovetail is a small axial ridge 44 (see FIG. 8) which extends from the forward end of the part 41, to about three-fourths the length of the part 41, thereby forming a ridge-free portion 46 (FIG. 5). When the blade is mounted on the hub 21, the ridge-free portion 46 is first inserted into a groove 31, and the absence of the ridge 44 makes insertion relatively easy. As the dovetail part is pressed fully into the groove 31, the ridge 44 is pressed tightly against the bottom of the groove and assures a tight connection.

The support part 43 extends upwardly from the upper neck 45 of the dovetail part 41. Immediately above the neck 45, the support part 43 includes a flat bottom rib or wall 48 which extends generally circumferentially in both directions from the neck 45, for approximately the rearward two-thirds of the length of the dovetail part 41. With reference to FIG. 3, on both sides of the outer opening of each of the dovetail grooves 31, flat surfaces 49 are formed, and the flat bottom of the wall 48 fits tightly against and is supported by the flat surfaces 49.

Radially outwardly of the dovetail 41 is a reinforced portion of the support part 43, which includes the wall 48, a rearward wall 52 and a forward wall 53. The three walls or ribs 48, 52 and 53 extend laterally in both directions from the center plate 51, and the ribs are joined together to form a strong box-like structure, the bottom rib 48 being supported against bending laterally by the flat surfaces 49. To conserve material and to keep the thicknesses of the parts substantially constant, the center space between the ribs 48, 52 and 53 may be left open or be formed with a reduced thickness. In the present instance, the center space is formed by a flat radially extending center plate 51 which is encompassed by the ribs 48, 52 and 53.

The rearward rib 52 is also connected for support to the flange 29. As best shown in FIGS. 5 and 6, a peg 56 extends forwardly from the rearward rib 52 and fits snugly in a similarly contoured hole 57 formed in the flange 29. As shown in FIGS. 2 and 3, a hole 57 is aligned with each of the grooves 31. Further, the rear wall 52 includes an axially rearwardly extending overhang 58 which extends over and closely adjacent the adjacent straight outer edge 59 of the flange. The box shape of the ribs 48, 52 and 53, plus the engagement between the laterally extending bottoms of the rib 48 with the surfaces 49, plus the engagement of the peg 56 in the hole 57, plus the engagement between the overhang 58 and the surface 59, cooperate to ensure a strong coupling between the blade part 42 and the hub 21.

As best shown in FIGS. 5, 6 and 7, the blade part 42 is formed by a flat plate that extends radially outwardly from the walls 52 and 53. The circumferential width of the walls 52 and 53 gradually narrows in the radially outward direction, and the wall 52 is reduced in width to that of the blade part 42.

FIG. 5 illustrates four different sizes of the blade part 42. The solid line 42A illustrates the largest size while the dashed lines 42B, 42C and 42D illustrate progressively smaller sizes. In each size, the blade part is widened in the axial direction over its outer portion, and the outer edge may be shaped to conform generally to (but not to touch) the inner surface of the shroud 17. While the radial dimensions of the sizes 42A, 42B, 42C and 42D are different, they all utilize the same shape of the dovetail part 41 and the support part 43 so that any of the sizes may be mounted on the hub 21.

The hub 21 may also be provided in different bore sizes. For example, the hub 21 may be provided with a smaller size internal bore, represented by the dashed line 27A in FIG. 4, for a smaller size motor shaft.

In practice, the hub 21 may be provided in a number of models which differ only in the size of the bore 27. Similarly, the blades 22 may be provided in a number of models which differ only in the size of the blade part 42. Consequently, all of the blade models may be attached to any of the hub models. For a given motor size, a hub model that matches the shaft is selected, and a blade model that matches the shroud size is selected, and the blades are mounted on the hub and the hub, of course, is mounted on the motor shaft.

A blade is mounted on the hub by inserting the rearward portion of the dovetail 41 into a groove 31. The dovetail enters the groove relatively easily but the fit becomes quite tight when the ridge 44 enters the groove. The dovetail is pressed rearwardly to cause the peg 56 to enter the hole 57 and the overhang 58 to engage the surface 59. At this point the rearward side of the wall 52 around the peg 56 engages the flange 29 and the forward side of the dovetail is substantially flush with the forward face 32 of the hub 21.

After the blades 22 are mounted in all of the grooves 31, a band clamp 61 (see FIG. 2) is positioned around the forward ends of the dovetails 41. As shown in FIG. 5, a band receiving slot 62 is formed by a raised projection 63 on the upper-forward end of the dovetail. The band clamp 61 (also shown in dashed lines in FIG. 5) is tightened on the dovetails, causing the dovetails to firmly engage the hub 21. The forward portion of the hub 21 is also tightened onto the motor shaft because the previously described radial openings through the forward portion of the hub permit this portion to flex inwardly as the clamp is tightened. Thus the clamp both secures the blades to the hub and the hub to the motor shaft.

The band clamp 61 is preferably a conventional screw-type locking clamp. The locking portion of the clamp is located diametrically opposite the plate 38 so that they may balance each other.

A fan constructed in accordance with the invention has numerous advantageous features. Since the blades are molded separately and apart from the hub, the mold sizes (and therefore the cost of the molds) are substantially reduced. The increased number of molded parts reduces the cost per unit and enhances the tooling cost justification. While there are multiple hub bore sizes and multiple blade sizes, costs are substantially reduced because all of the blade sizes may be mounted on any of the hubs. A single mold may be used to produce all of the hub sizes by inserting a different pin size (for each bore diameter) into the mold for the hub. A family of molds is provided for the blades, one mold for each blade size. The blade molds differ only in the size of the blade part.

Even though the fan is formed from a number of separate pieces, an assembled fan is strong enough to withstand the operational stresses at customary speeds and temperatures. The dovetail interlocking connection, the shape of the box-like walls or ribs 48, 52 and 53 and their connections with the hub (i.e., the pin 56 connection, the engagement of the overhang 58 with the flange 29, and the engagement of the surfaces 49), form a strong joint between the blade and the hub. The shape of the ribs 48, 52 and 53 minimize vibration modes by transmitting bending stresses from the blades into the hub, and the tapers of the walls 52 and 53 blend into the blade part, thereby raising the blade bending natural frequency without producing distinct locations of stress concentrations. The peg 56 and the overhang 58 transmit shear forces from the blade to the hub, and thereby increase the strength of the joint. A single band clamp secures the blades and the hub together and to the motor shaft. Further, the clamp and the ridge 44 assist in forming a strong, secure joint between the parts.

What is claimed is:

1. A fan for an electric machine, comprising:

(a) a hub having a bore therethrough for receiving a rotatable shaft of the machine;

(b) a plurality of fan blades, each of said blades being formed separately from and secured to said hub;

(c) said hub and each of said fan blades comprising interlocking means;

(d) each of said fan blades further comprising a blade part and a support part between said blade part and said interlocking means, said support part engaging and being connected with said hub; and (e) a clamp tightening and securing said interlocking means.

2. A fan for an electric machine, comprising:

(a) a hub having a bore therethrough for receiving a rotatable shaft of the machine;

(b) a plurality of fan blades, each of said blades being formed separately from and secured to said hub;

(c) said hub and each of said fan blades comprising interlocking means;

(d) each of said fan blades further comprising a blade part and a support part between said blade part and said interlocking means, said support part being connected with said hub, said bore having an axis of rotation, said interlocking means extending parallel to said axis, and said support part including ribs that extend laterally of said axis and engage an outer surface of said hub adjacent said interlocking means.

3. A fan for an electric machine, comprising:

(a) a hub having a bore therethrough for receiving a rotatable shaft of the machine;

(b) a plurality of fan blades, each of said blades being formed separately from and secured to said hub;

(c) said hub and each of said fan blades comprising interlocking means;

(d) each of said fan blades further comprising a blade part and a support part between said blade part and said interlocking means, said support part being connected with said hub, said hub including a flange which extends radially outwardly of said interlocking means, said flange including an opening therein adjacent said interlocking means, said support part including a peg extending into said opening and engaging said flange.

4. A fan as set forth in claim 3, wherein said interlocking means further comprises an overhang portion which overlies and engages an outer edge of said flange adjacent said opening.

5. A fan as set forth in claim 2, wherein said ribs comprise radially and axially extending portions which are joined to form a box-like configuration, said ribs tapering and merging with said blade part.

6. A fan as set forth in claim 1, wherein said interlocking means comprises a circumferentially widened groove formed in and extending axially of said hub, and a circumferentially widened portion formed on said blade, said widened portion having a configuration mating with said groove.

7. A fan as set forth in claim 6, wherein said groove and said widened portion have a dovetail shape.

8. A fan as set forth in claim 6, wherein said widened portion has a ridge formed thereon, said ridge engaging a side of said groove for tightening said interlocking means.

9. A fan for an electric machine, comprising:

(a) a hub having a bore therethrough for receiving a rotatable shaft of the machine;

(b) a plurality of fan blades, each of said blades being formed separately from and secured to said hub;

(c) said hub and each of said fan blades comprising interlocking means;

(d) each of said fan blades further comprising a blade part and a support part between said blade part and said interlocking means, said support part being connected with said hub, said interlocking means comprising a circumferentially widened groove formed in and extending axially of said hub, and a circumferentially widened portion formed on said blade, said widened portion having a configuration mating with said groove, and an annular clamp extending around said widened portions of said blades, said clamp tightening said widened portions in said groove.

10. A fan as set forth in claim 9, wherein radially extending openings are formed in said hub adjacent said clamp, said clamp further being operable to tighten said hub against the shaft of the machine.

11. A fan as set forth in claim 9, wherein said clamp includes a band and a lock on one side thereof, and said flange includes a balance portion on a side substantially opposite from said lock.

* * * * *